US005967018A

United States Patent [19]

Breveglieri

[11] Patent Number: 5,967,018

[45] Date of Patent: Oct. 19, 1999

[54] HYDRAULIC MOTOR WITH RADIAL PROPULSORS RETAINED AGAINST CORRESPONDING SLIDING-CONTACT SURFACES BY RESILIENT MEANS AND BY MECHANICAL-RETAINING MEANS LOCATED OUTSIDE SAID PROPULSORS

[75] Inventor: Alessandro Breveglieri, Bologna, Italy

[73] Assignee: Riva Calzoni S.P.A, Bologna, Italy

[21] Appl. No.: 08/987,545

[22] Filed: Dec. 9, 1997

[30] Foreign Application Priority Data

Dec. 23, 1996 [IT] Italy ..... MI96A2731
Feb. 27, 1997 [IT] Italy ..... MI97A0428

[51] Int. Cl.[6] ..... F01B 13/06

[52] U.S. Cl. ..... 92/12.1; 92/58; 92/72; 417/269; 417/273

[58] Field of Search ..... 92/12.1, 58, 72; 417/269, 273

[56] References Cited

U.S. PATENT DOCUMENTS 3,885,459 5/1975 Freese .
4,629,401 12/1986 Grote ..... 417/273
5,131,818 7/1992 Wittkop et al. ..... 417/273
5,383,770 1/1995 Hisahara ..... 417/273
5,632,191 5/1997 Lemaire et al. ..... 92/72 X

FOREIGN PATENT DOCUMENTS 1 548 517 10/1968 France .
2 230 877 12/1970 France .
1 303 732 1/1973 United Kingdom .

*Primary Examiner*—Hoang Nguyen
*Attorney, Agent, or Firm*—Herbert Dubno

[57] ABSTRACT

A hydraulic motor with propulsion members located between an eccentric cam associated with a shaft and a counter-element. The propulsion members consist of two elements slidable telescopically with respect to one another in the longitudinal direction and having annular bearing shoulders kept pressed against corresponding sliding-contact surfaces of the eccentric cam and the counter-element by springs. The resilient springs are located outside the propulsion members and are arranged between the annular edges and elements for mechanically retaining them.

34 Claims, 4 Drawing Sheets

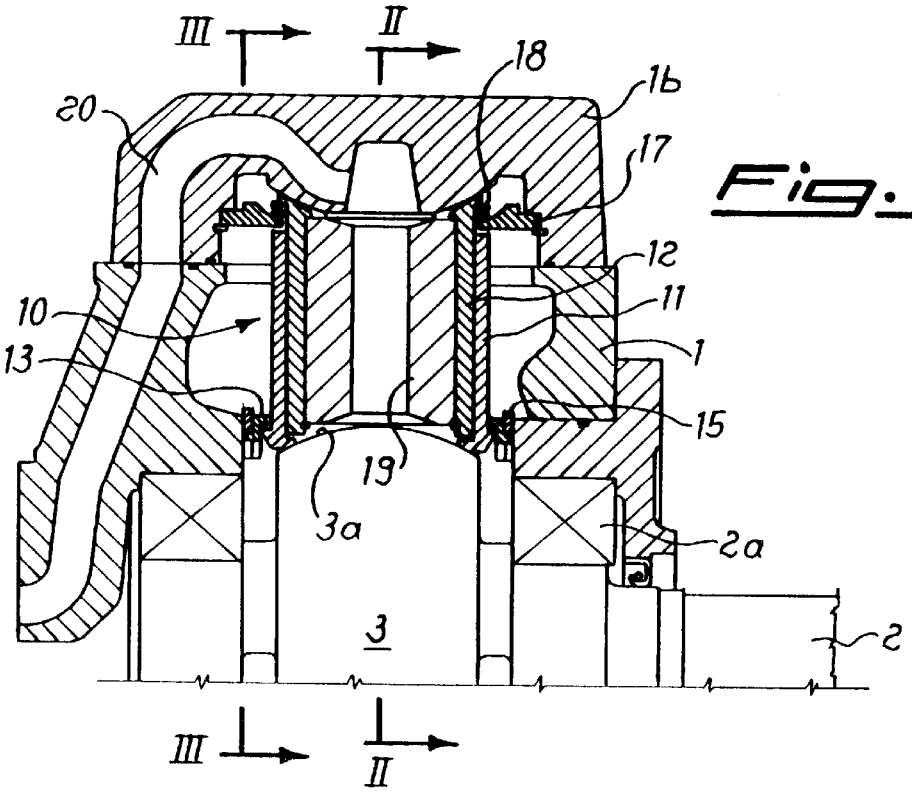
Fig.1
Fig.1a
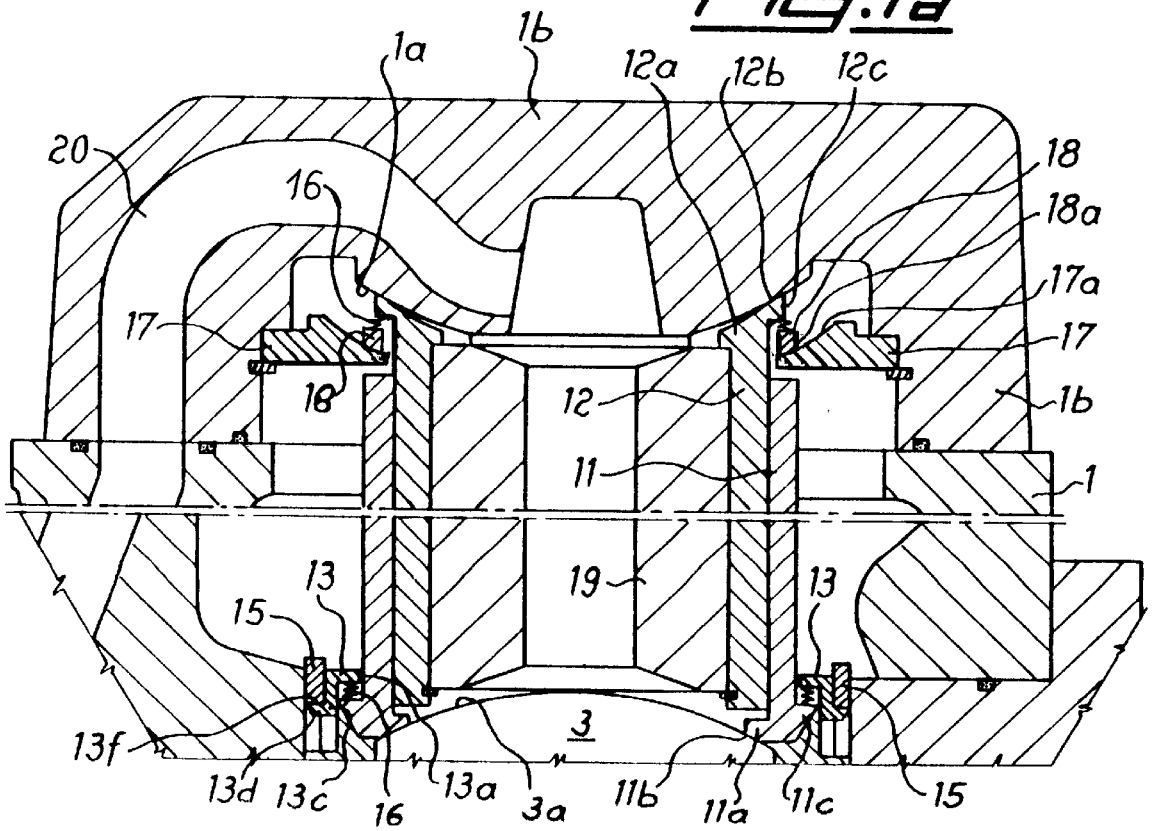

HYDRAULIC MOTOR WITH RADIAL PROPULSORS RETAINED AGAINST CORRESPONDING SLIDING-CONTACT SURFACES BY RESILIENT MEANS AND BY MECHANICAL-RETAINING MEANS LOCATED OUTSIDE SAID PROPULSORS

FIELD OF THE INVENTION

The present invention relates to a hydraulic motor with propulsion members retained against corresponding sliding-contact surfaces by resilient means located outside the said propulsion members and arranged between the latter and associated means for mechanically retaining them.

BACKGROUND OF THE INVENTION

In the field of motors with propulsion members which are moved by means of the supply of a fluid and are therefore generally defined as hydraulic, it is known of the possibility of provide the propulsion members with a cylinder and a piston which are telescopically coupled together so as to translate relatively upon rotation of an eccentric cam associated with the drive shaft, thus providing thrust to the shaft itself.

Said propulsors may be arranged radially or inclined as described Ser. No. 09/01708 filed Feb. 2, 1998 in co-pending patent application in the name of the same Applicant.

It is also known that one of the problems posed by these propulsors is the need to keep the end edge of the cylinder and the piston sealingly adherent with respect to the said eccentric cam and a reaction element consisting of a cover-piece fixed to the casing of the motor in the case of radial motors or a disc keyed onto the drive shaft in the case of inclined propulsors, so as not to cause fluid leakages during the relative travel between piston and cylinder. One of the solutions commonly used to obtain this seal consists in the insertion, inside each propulsion member, of a resilient element, such as a helical spring for example, arranged coaxially with respect to the propulsor and designed to push against corresponding internal shoulders of the cylinder and the piston so as to press said cylinder and piston against the associated abutment surfaces.

An example of this type of embodiment is known from the U.S. Pat. No. 3,577,830 in the name of the same Riva Calzoni S.p.A. This solution, however, has some drawbacks including those caused by the dynamic stresses to which the spring is subjected during travel of the piston with respect to the cylinder, which results in the need for over-dimensioning of the spring itself, causing a strong thrust on the sliding surfaces making contact, with consequent greater wear of the latter.

In addition to this, the presence of the spring and the associated support shoulders for them inside the cylinder prevents a reduction in the volume of fluid which does not emerge from the cylinder at the end of the compression phase (so-called dead volume), increasing the problems of exchanging the fluid itself with fresh fluid supplied by the delivery ducts.

OBJECTS OF THE INVENTION

The object of the invention is to that of providing a hydraulic motor in which there are provided means for mechanically retaining each propulsion member against respective abutment and sliding-contact surfaces where a hydraulic seal against leakage of the thrusting fluid must be ensured.

Another object is to provide a mechanical-retaining means which comprises resilient means acting on the propulsion members with a thrust in a direction parallel to that of their longitudinal axis, which is independent of the working phase (compression/discharge) of the propulsion member itself.

Still another object is to provide a hydraulic motor wherein the resilient retaining means is be easy and economical to construct and install on motors of the known type and allow the motor to be used also as a pump.

SUMMARY OF THE INVENTION

These technical problems are solved according to the present invention by a hydraulic motor with propulsion members located between an eccentric cam associated with the drive shaft and a counter-element. The propulsion members consist of two elements slidable telescopically with respect to one another in the longitudinal direction and having annular bearing edges kept pressed against corresponding sliding-contact surfaces of said eccentric cam and counter-element by means of associated resilient means, wherein the resilient means are arranged outside the propulsion members and located between the annular edges and associated means for mechanically retaining them.

DESCRIPTION OF THE DRAWING

The above and other objects, features, and advantages will become more readily apparent from the following description, reference being made to the accompanying drawing in which:

FIG. 1 shows a partially sectioned diagrammatic view of a radial motor according to the invention taken along a plane parallel to the axis of the drive shaft;

FIG. 1*a* shows a detail, on a larger scale, of a propulsion member of the motor according to FIG. 1;

SPECIFIC DESCRIPTION

Figure 2:
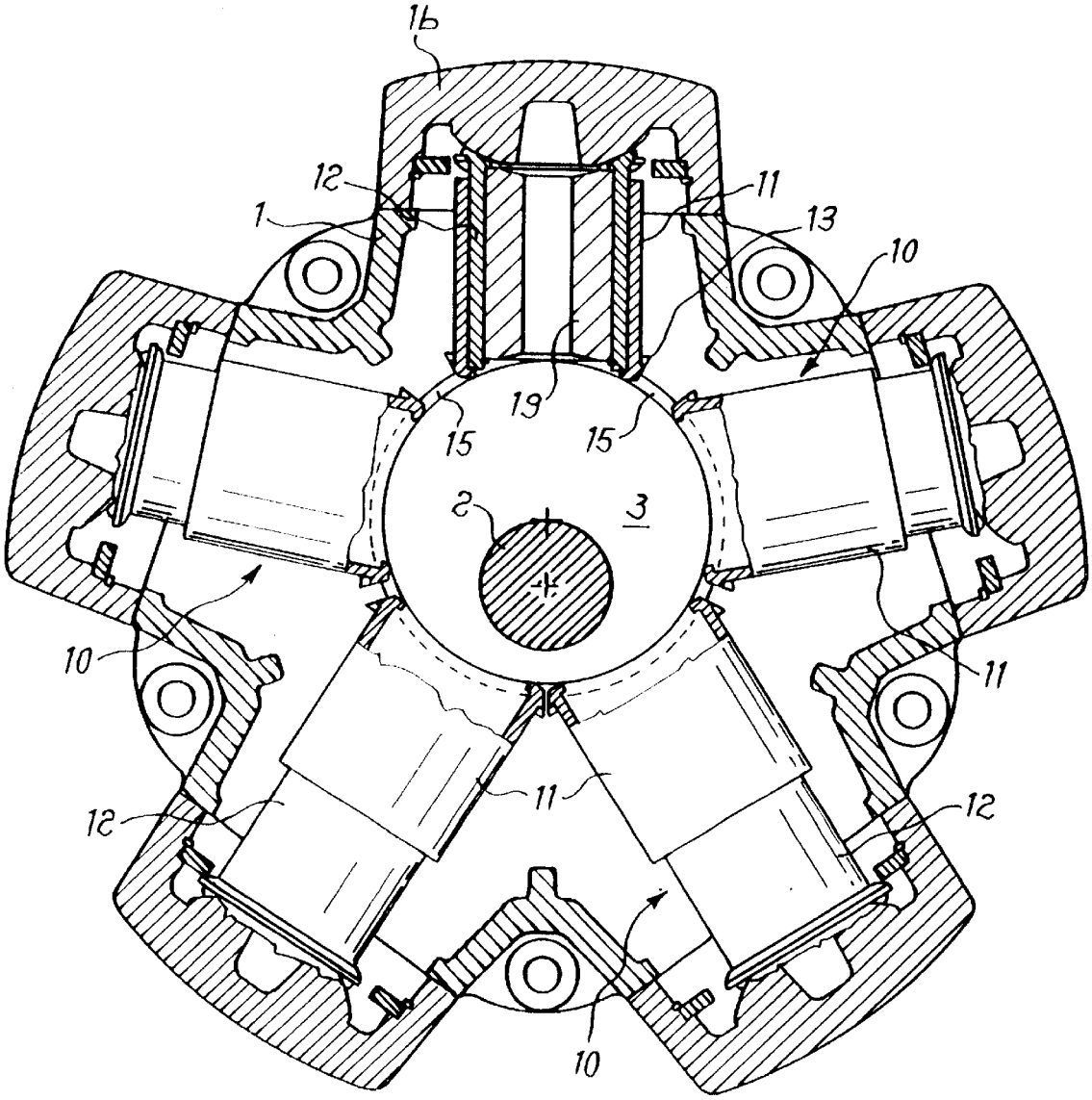
FIG. 2 is a cross-section taken along the plane II—II in FIG. 1.
Figure 3:
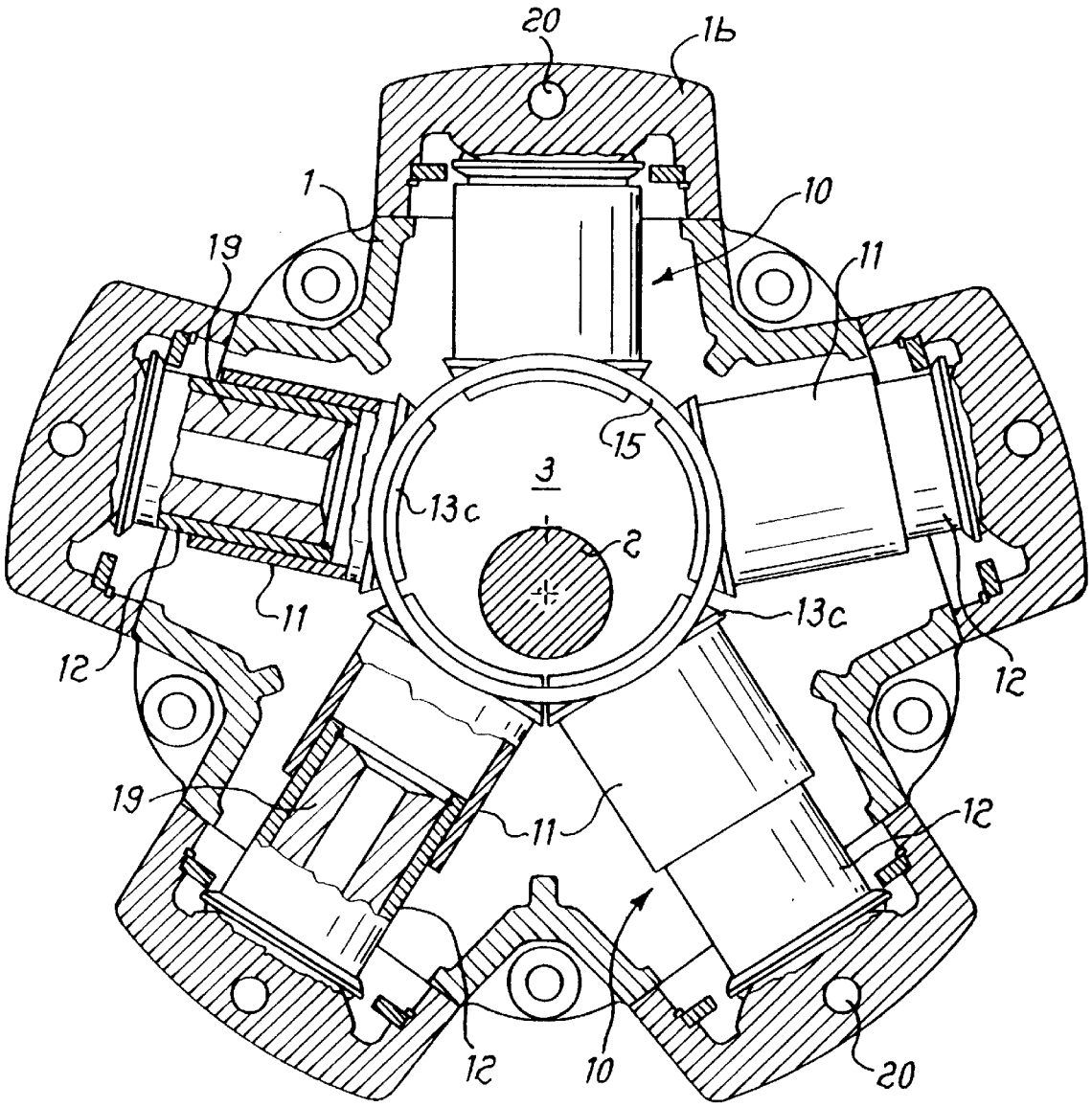
FIG. 3 is a cross-section taken along the plane III—III in FIG. 1.

As illustrated (FIGS. 1, 1*a*, 2, 3), the hydraulic motor according to the invention in the version with radial propulsors comprises a casing 1 which houses inside it the shaft 2 mounted on bearings 2*a* and carrying the eccentric cam 3 against which the propulsion members 10 act radially.

The propulsion members 10 each comprise a in turn consist of a cylinder 11, one of the two end edges of which bears against the external surface 3*a* of the said eccentric cam 3, and a piston 12, slidable telescopically in the radial direction inside the cylinder 11 and having one of the two end edges in abutment against a spherical surface 1*a* formed inside covers 1*b* fastened to the casing 1 of the motor by suitable fixing means not shown.

The bearing edge of cylinder 11 and piston 12 against the respective sliding-contact surfaces 1*a* and 3*a* of the cover 1*b* and the eccentric cam 3 (FIG. 1*a*) substantially consists of an annular edge 11*a*, 12*a* having a contact surface 11*b*,12*b*, parallel with the surface of the eccentric cam, and a tooth 11*c*,12*c* extending towards the outside and designed to engage with the radial retaining means described below.

The retaining means comprise essentially three elements both in the zone of contact between cylinder 11 and eccentric cam 3 and in the zone of contact between piston 12 and cover 1*b*.

In the zone of contact between the cylinder 11 and the eccentric cam 3, the retaining elements are composed of a sliding piece 13 provided with a coaxial hole 13*a* having a diameter slightly greater than the external diameter of the cylinder 11 so as to allow the latter to pass through.

The sliding piece 13 has moreover at least one pair of edges 13*c*, which are opposite and parallel, having a substantially L-shaped section and extending along a substantially cylindrical profile, coaxial with the axis of the eccentric cam 3.

The short arm 13*d* of each "L" has an upper surface 13*f* designed to form an engaging seat for a ring 15 having its center on the axis of the drive shaft 2 and arranged around each edge 13*c* of all the sliding pieces 13 retaining each cylinder 11.

In this way the opposing rings 15 retain radially all the sliding pieces 13 which, in turn, keep the associated cylinder 11 in abutment against the eccentric cam 3 during rotation thereof. In order to ensure adherence between the sliding piece 13 and the base 11*a* of the cylinder 11, a resilient element is arranged between them, said element in the example consisting of a wave spring 16 designed to impart a radial force of relative contact between the surfaces making sliding contact, said force being constant and independent of the working phases of the propulsion member 10.

In the zone of contact between piston 12 and cover 1*a* (FIG. 1*a*) the retaining elements again consist of a ring 17 which is centered on the radial axis and fastened to the cover 1*b* of the motor and which has a concave spherical surface 17*a* designed to press on a corresponding convex spherical surface 18*a* of a sliding piece 18 in turn acting in the radial direction against an annular edge 12*a* of the piston 12.

In this case also a wave spring 16 is arranged between sliding piece 18 and annular edge 12*a* in order to ensure constant adhesion of the sliding-contact surfaces during the various working phases of the propulsion member 10.

Figure 4:
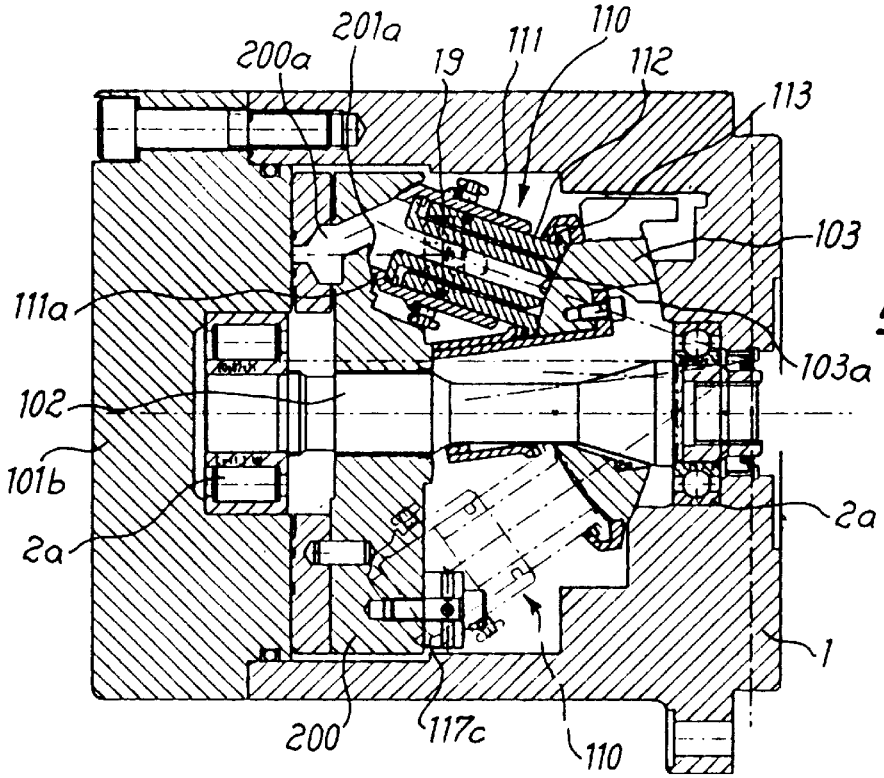
FIG. 4 is a section along a vertical plane of a motor according to the invention with inclined propulsion members.
Figure 5:
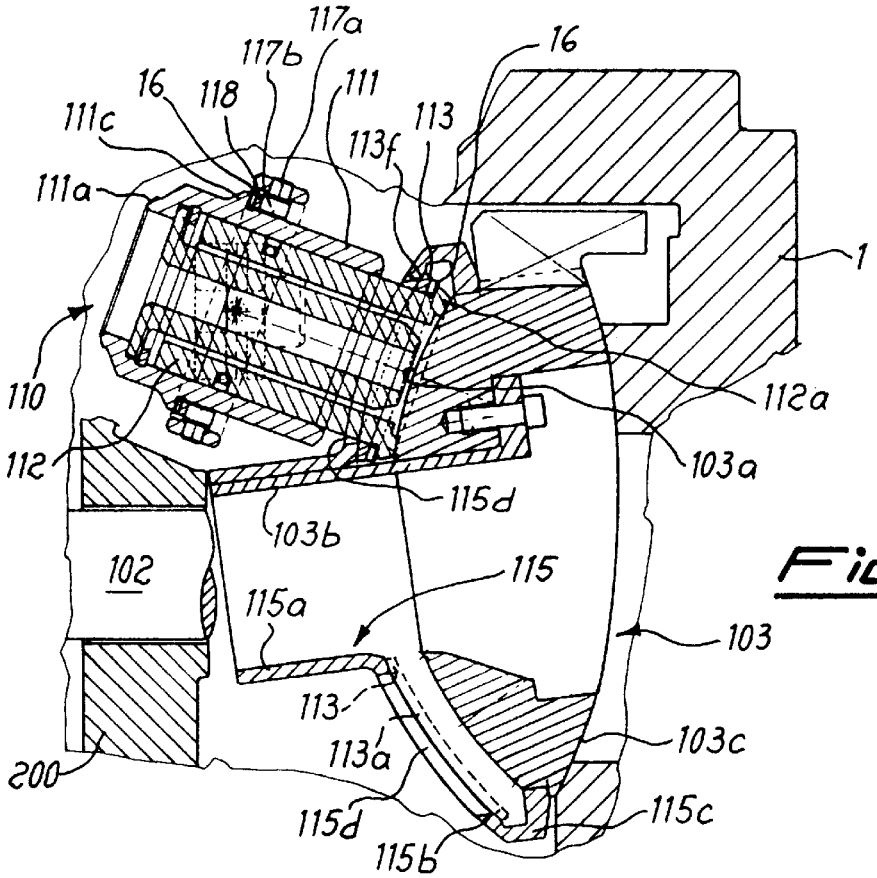
FIG. 5 is a detail, on a larger scale, of the propulsion members according to FIG. 4.

As illustrated in FIGS. 4 and 5, if the hydraulic motor is of the type with propulsors 110 which are inclined, i.e. having their longitudinal axis inclined both with respect to the drive shaft 102 and with respect to the longitudinal axis of the other propulsors, the latter are arranged between a disc 200 keyed onto the shaft 102 and an eccentric cover-piece 103 which is substantially bell-shaped and which has a narrow part forming a hollow tube 103*b* and a wide part with opposite convex surfaces 103*a*,103*c*, the surface 103*a* of which is substantially spherical and the surface 103*c* of which may be either spherical or cylindrical, the surface 103*a* forming the surface for sliding and contact of the piston 112.

Said disc 200 has in turn spherical seats 201*a* for making contact with one end 111*a* of the cylinder 111.

In this version of the motor, retaining of the piston 111 against the eccentric cam 103 is performed by means of retaining and locking means consisting of a sliding piece 113 having a hole 113*a* with a diameter slightly greater than the external diameter of the piston 112 so as to allow it to pass through.

The sliding piece 113 has an upper surface 113f designed to form an engaging seat for a bowl-shaped element 115 comprising a hollow cylindrical part 115*a*, coaxial with the tube 103*b* of the eccentric cam 103, and a bowl-shaped part 115*b* with an edge 115*c* turned back to allow engagement with the eccentric cam 103.

The bowl-shaped part 115*b* has moreover openings 115*d* designed to allow the propulsion member 110 to pass through. In this way the bowl 115, once engaged with the eccentric cam 103, presses against each edge 113*f* of all the sliding pieces 113 arranged around each piston 112, sliding pieces which, in turn, keep the associated piston 112 in abutment against the eccentric cam 103 during rotation thereof.

In order to ensure adherence between the sliding piece 113 and the edge 112*a* of the piston 112, a resilient element is arranged between them, said element in the example consisting of a wave spring 16 designed to impart a force of relative contact between the sliding-contact surfaces; said force is constant and independent of the working phases of the propulsion member 110 and compatible with the spatial position assumed by the eccentric cam 103.

In the zone of contact between the cylinder 111 and the disc 200 the retaining elements again consist of a sliding piece 118 pushed in abutment against the shoulder 111*c* of the cylinder 111 by a ring 117*a* coaxial with the cylinder 111 and associated with two pins 117*b*, the axes of which are situated on a radial axis of the cylinder and fastened to the disc 200 by means of supports 117*c*.

In this case also a wave spring 16 is arranged between the sliding piece 118 and the annular edge 111*a* so as to ensure constant adhesion between the sliding-contact surfaces during the various working phases of the propulsion member 110.

Since the ring 117*a* allows in turn rotation of the cylinder 111 about a radial axis, the cylinder ill is substantially as a whole designed to rotate about a centre point arranged on its longitudinal axis, so as to follow spherical trajectories during rotation of the drive shaft; this prevents the propulsion member 110 from losing adherence against the associated contact surfaces 200*a* of the disc 200 and 103*a* of the eccentric cam 103, during rotation of the said disc and cam.

It is therefore obvious how the retaining devices arranged outside the propulsion members provide two main advantages compared to the known art; they in fact allow filling of the chamber of the cylinder 11 with high-volume and low-weight bodies 19, resulting in a reduced dynamic imbalance and reduction in the dead volumes of fluid.

Moreover, the external retaining devices also allow the fluid entering into the propulsors through the supply ducts to be supplied directly onto the sliding contact-surfaces which are most exposed to wear, therefore ensuring greater lubrication where most needed in order to reduce said wear.

Said resilient means are moreover not subject to the dynamic loads arising from the relative travel of piston and cylinder of the propulsion member at each rotation of the eccentric cam.

The solution described above, according to which cylinders and pistons are engaged with associated sliding-contact surfaces, also allows the cylinders to perform a fluid suction function without loss of adherence to the said surfaces, the apparatus therefore being able to be operated as a pump instead of as a motor.

I claim:

1. A hydraulic motor comprising:

propulsion members angularly spaced around an axis;

a shaft rotating about said axis;

an electric cam connected with said shaft;

a counter-element surrounding said cam, said propulsion members being located between said cam and said counter-element and each consisting of two elements telescopically slidable with respect to one another in a longitudinal direction and having annular bearing edges kept pressed against corresponding sliding-contact surfaces of said eccentric cam and said counter-element;

resilient means for pressing said edges against said surfaces; and associated means independent of said elements, said resilient means being resilient means arranged outside said propulsion members between said annular edges and said associated means mechanically retained by said associated means, said associated means having inwardly extending formations and said propulsion members having outwardly extending formations, said resilient means being located between said formations.

2. The motor according to claim 1 wherein said resilient means are springs.

3. The motor according to claim 2 wherein said springs are flexural springs.

4. The motor according to claim 2 wherein said springs are flexural/torsional springs.

5. The motor according to claim 2 wherein said springs are cup springs.

6. The motor according to claim 1 wherein said propulsion members are arranged in radial directions with respect to the axis of the drive shaft.

7. The motor according to claim 6 wherein the pressing action of the propulsion members occurs in the radial direction.

8. The motor according to claim 6 wherein said counter-element is a cover of the motor.

9. The motor according to claim 8 wherein said cover has spherical contact and sliding seats for a piston forming one of the elements of a respective propulsion member.

10. The motor according to claim 8 wherein said associated means comprise a least one sliding piece, coaxial with a respective propulsion member and engaged with said annular edges thereof, and at least one pair of elements for constraining said sliding piece in the radial direction.

11. The motor according to claim 10 wherein said sliding piece is provided for retaining the resilient means and has a hole for coaxial insertion onto the cylinder and at least one pair of opposite and parallel edges with a substantially L-shaped section.

12. The motor according to claim 11 wherein said opposite and parallel edges extend over a cylindrical profile coaxial with an axis of the eccentric cam.

13. The motor according to claim 10 wherein said elements for constraining the sliding piece consist of a pair of rings having their center on the axis of the motor and engaged on a respective L-shaped edge of said sliding pieces.

14. The motor according to claim 10 wherein said sliding piece for retaining the piston against the corresponding spherical surface of the cover for the motor consists of a ring coaxial with said piston and having at least one spherical surface concentric with the spherical surface and with convexity directed towards the axis of rotation of the drive shaft.

15. The motor according to claim 14 wherein said means for retaining the piston in the radial direction consist of a ring with a center on a radial axis of the piston and fixed to a casing of the motor.

16. The motor according to claim 15 wherein said ring fixed to the casing of the motor has at least one concave spherical surface concentric with the spherical surface and designed to cooperate with said convex surface of said sliding piece.

17. The motor according to claim 1 wherein said propulsion members are arranged with respective longitudinal axes inclined both with respect to the axis of the shaft and with respect to the axis of the other propulsion members.

18. The motor according to claim 17 wherein said propulsion members are located between a disc keyed onto the shaft and an eccentric body.

19. The motor according to claim 18 wherein said eccentric body is substantially bell-shaped with a narrow part forming a hollow tube and a wide part with opposite convex surfaces.

20. The motor according to claim 19 wherein said opposite convex surfaces are spherical surfaces.

21. The motor according to claim 19 wherein one of said opposite convex surfaces is spherical.

22. The motor according to claim 19 wherein one of said opposite convex surfaces is cylindrical.

23. The motor according to claim 20 wherein said surface of the eccentric cam forms the contact and sliding surface of one end of the propulsion member.

24. The motor according to claim 23 wherein said end is one end of a cylinder.

25. The motor according to claim 19 wherein said disc keyed to the shaft has spherical seats making contact with one end of the propulsion member.

26. The motor according to claim 25 wherein said end is one end of the piston.

27. The motor according to claim 19 wherein said means for retaining and locking the propulsion member to the eccentric cam consist of a sliding piece and a bowl-shaped element.

28. The motor according to claim 25 wherein said sliding piece has a hole with a diameter slightly greater than the external diameter of the piston so as to allow it to pass through and an upper surface designed to form an engaging seat for said bowl-shaped element.

29. The motor according to claim 25 wherein said bowl-shaped element has a hollow cylindrical part coaxial with the tube of the eccentric cam and a bowl-shaped part with an edge turned-back to allow engagement with the eccentric cam.

30. The motor according to claim 29 wherein said bowl-shaped element has openings designed to allow the propulsion members to pass through so that the latter may be simultaneously retained against the surface of the eccentric cam.

31. The motor according to claim 19 wherein the elements for retaining the cylinder against the disc consist of a sliding piece pushed in abutment against the shoulder of the cylinder by a ring associated with two pins having their axis on a radial axis of the cylinder and fastened to the disc integral with the drive shaft.

32. The motor according to claim 31 wherein said ring is fastened to the disc by means of a support designed to allow rotation of the ring about a radial axis of the cylinder.

33. The motor according to claim 31 wherein the cylinder oscillates about an axis of rotation perpendicular to the axis of rotation of the ring.

34. The motor according to claim 1 which is configured to operate as a pump.

* * * * *